US006130693A

United States Patent [19]

Ims et al.

[11] Patent Number: 6,130,693

[45] Date of Patent: Oct. 10, 2000

[54] INK JET PRINTHEAD WHICH PREVENTS ACCUMULATION OF AIR BUBBLES THEREIN AND METHOD OF FABRICATION THEREOF

[75] Inventors: Dale R. Ims, Webster; Michael P. O'Horo, Fairport; Donald J. Drake; Brian S. Hilton, both of Rochester, all of N.Y.

[73] Assignee: Xerox Corporation, Stamford, Conn.

[21] Appl. No.: 09/004,643

[22] Filed: Jan. 8, 1998

[51] Int. Cl.[7] ..... B41J 2/05

[52] U.S. Cl. ..... 347/65

[58] Field of Search ..... 347/63, 65, 92

[56] References Cited

U.S. PATENT DOCUMENTS

| | | | |
|---|---|---|---|
| Re. 32,572 | 1/1988 | Hawkins et al. | 156/626 |
| 4,638,337 | 1/1987 | Torpey et al. | 347/65 |
| 4,774,530 | 9/1988 | Hawkins | 346/140 |
| 4,788,556 | 11/1988 | Hoisington et al. | 346/1.1 |
| 4,829,324 | 5/1989 | Drake et al. | 347/63 |
| 4,947,192 | 8/1990 | Hawkins et al. | 346/140 |
| 4,947,193 | 8/1990 | Deshpande | 346/140 |
| 4,994,826 | 2/1991 | Tellier | 347/65 |
| 5,132,707 | 7/1992 | O'Neill | 347/65 |
| 5,339,102 | 8/1994 | Carlotta | 347/32 |
| 5,404,158 | 4/1995 | Carlotta et al. | 347/32 |

*Primary Examiner*—Fred L Braun
*Attorney, Agent, or Firm*—Robert A. Chittum

[57] ABSTRACT

A printhead and method of fabrication thereof provides that the printhead reservoir has substantially the same cross-sectional ink flow area as the total cross-sectional area of the plurality of individual ink channels which interconnect the reservoir with the printhead nozzles. Since the flow area of the reservoir is substantially matched to the total flow area of the channels, the ink capacity of the reservoir is relatively low and the flow rate therethrough during a printing operation is relatively high. The small capacity of reservoir, together with the high ink flow rate therethrough, assures short ink residency time during printing, so that any exsolved air bubbles in the ink are swept away with subsequent ink droplet ejections during a printing operation and thus prevents any air bubbles present from coalescing into larger bubbles which can cause print quality defects.

10 Claims, 5 Drawing Sheets

INK JET PRINTHEAD WHICH PREVENTS ACCUMULATION OF AIR BUBBLES THEREIN AND METHOD OF FABRICATION THEREOF

BACKGROUND OF THE INVENTION

The present invention relates to droplet-on-demand type ink jet printing systems, and more particularly to ink jet printheads for such printing systems which prevent accumulation and growth of air bubbles in the ink reservoirs of the printheads.

It is well known that the printheads for droplet-on-demand type ink jet printers should be free of air pockets or air bubbles for sustained quality printing, for the bubbles restrict the flow of ink to the nozzles when they grow and reach a sufficient size. Not only can the restriction slow the refill of the passageways or channels to the nozzles, but can block the refill and prevent droplet ejection. Although some air bubbles and dissolved air can be tolerated without print quality being impaired, once air bubbles are present, they tend to grow during the printing operation. Therefore, it is highly desirable to remove continually any air bubbles from the ink supply reservoir during the printing operations so that the air bubbles do not accumulate and coalesce into large enough air bubbles to become a problem.

Air is generally removed by priming the printhead at a maintenance station, such as, for example, as disclosed in U.S. Pat. No. 5,404,158. The priming procedure basically sucks ink from the nozzles bringing with it any air bubbles. Even when this deaerating procedure works, it wastes valuable ink which has been purchased by the end user. Also, in U.S. Pat. No. 5,339,102, the attempt to remove air bubbles from the printhead is done by a priming operation while the printhead is capped at the maintenance station. Unfortunately, the withdrawal of ink by priming does not always remove ink flow restricting air bubbles from the printhead reservoirs or adjacent ink supply passageways, with the result that some nozzles are starved of ink and fail to eject droplets.

U.S. Pat. No. 5,946,015 entitled "Method and Apparatus For Air Removal From Ink Jet Printheads" and assigned to the same assignee as the present invention discloses a decompression technique for removing or relocating air pockets from the reservoirs of ink jet printheads. In one embodiment, an ink jet cartridge, after being filled with ink, is subjected to a relatively high vacuum in an evacutable container. In another embodiment, an accessory kit is used to subject the printhead nozzles and cartridge vent to a high vacuum source after the cartridge is installed in the printer. The nozzles have a higher flow impedance than the printhead ink inlet, so that air bubbles, which expand under a vacuum, move from the printhead reservoir to the cartridge where they do not restrict printhead operation and once removed from the reservoir tend not to reappear there.

U.S. Pat. No. 4,788,556 discloses a deaerator for removing gas dissolved in hot melt ink at elevated temperatures from molten ink in a hot melt ink jet system. An elongated ink path leading to an ink jet printhead is formed between two gas permeable membranes. The membranes are backed by air plenums which contain support members to hold the membranes in position. Reduced pressure is applied to the plenums to extract dissolved air from the molten ink in the ink path. Increased pressure can also be applied to the plenums to eject ink from the printhead for purging.

U.S. Pat. No. 5,808,643 entitled "Air Removal Means For Ink Jet Printers" and assigned to the same assignee as the present invention discloses a method and apparatus for removing dissolved air in ink and air bubbles or air pockets from ink passageways in ink jet printer cartridges by use of a permeable membrane tubing member positioned in the ink at a location adjacent the ink inlet of the printer's droplet ejecting printhead. The permeable membrane tubing member is connected to a vacuum source to diffuse air into the vacuum in the tubing member interior. The vacuum source may be by a direct connection to the printer's vacuum priming pump at its maintenance station, a separate vacuum pump, or a vacuum accumulator.

The generation of exsolved gas or air bubbles in the printhead reservoirs is known to be a significant source of print quality defects. This is especially true for silicon die printheads having etched ink reservoirs, because of the reservoir size and shape. Although this problem of air bubble accumulation and coalescence is well known, prior attempts to solve this problem usually involve adding extra apparatus to the printer.

SUMMARY OF THE INVENTION

It is an object of the present invention to flush or sweep all air bubbles from the printhead reservoir by keeping the reservoir cross-section and volume relatively small, so that during the printing operations, the ink flow rate through the reservoir is relatively high.

In one aspect of the invention, there is provided an ink jet printhead which prevents accumulation of air bubbles therein, comprising: a heater plate having on one surface thereof an array of heating elements, addressing circuitry means, and electrical leads for the selective application of electrical pulses to each of the heating elements, each of the selectively applied pulses ejecting an ink droplet from the printhead; a planar structure having a plurality of ink flow directing channels with substantially equal cross-sectional areas and opposing ends, the channels having one end open and the other end in fluid communication with an ink reservoir, the reservoir providing an ink supply from which the channels are capillarily refilled when ink droplets are ejected from the printhead, the reservoir having a cross-sectional area in an orientation substantially perpendicular to the ink flow direction therethrough, which relative to the total cross-sectional areas of the channels, is sufficient to maintain a relatively high ink flow rate through the reservoir during a printing operation, so that air bubbles, formed during the droplet ejection process are removed with subsequent droplet ejections.

BRIEF DESCRIPTION OF THE DRAWINGS

The present invention will now be described by way of example with reference to the accompanying drawings, in which like reference numerals refer to like elements, and in which.

DESCRIPTION OF THE PREFERRED EMBODIMENT

Figure 1:
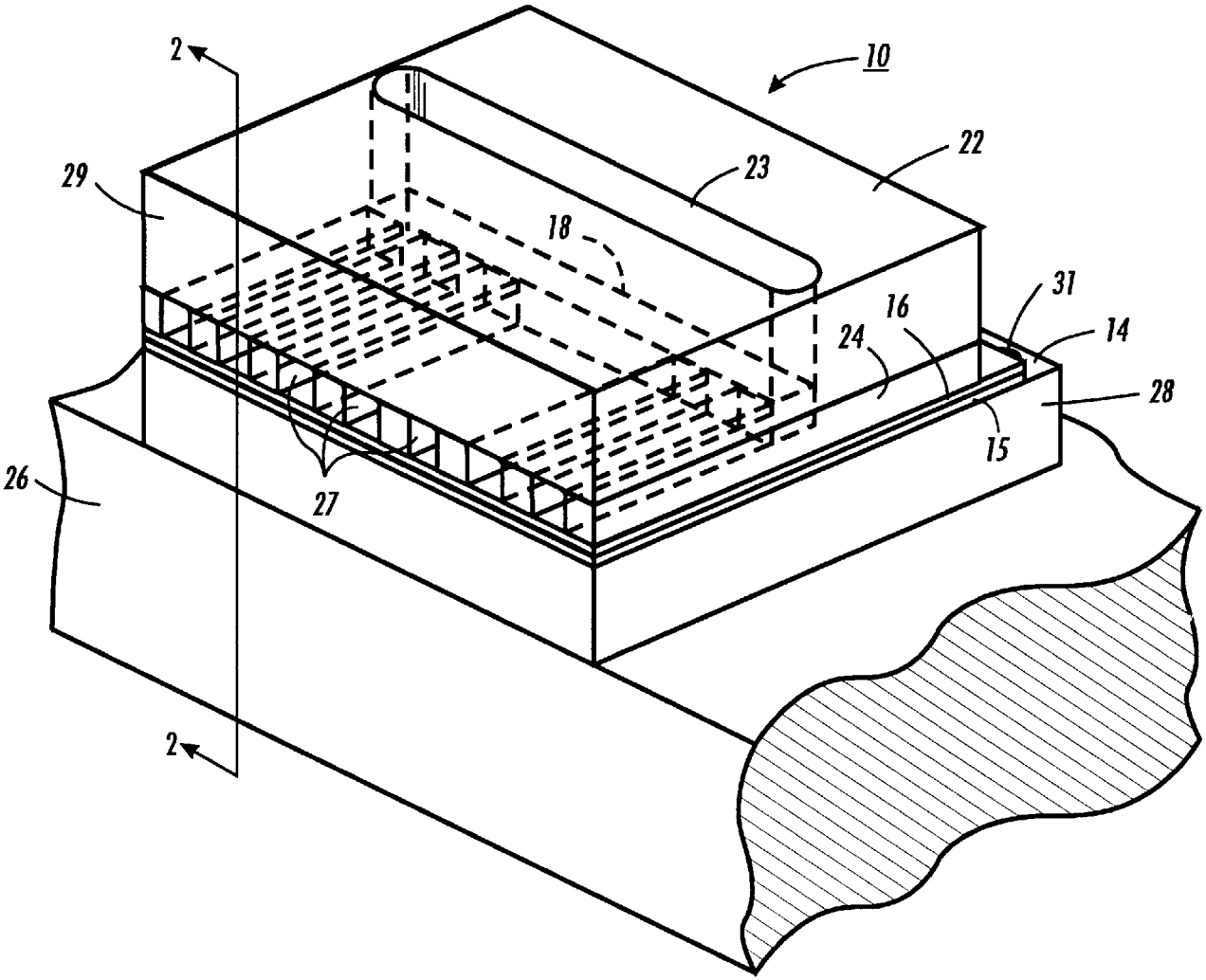
FIG. 1 is a schematic isometric view of a printhead in accordance with the present invention and oriented to show the droplet ejecting nozzles.
Figure 2:
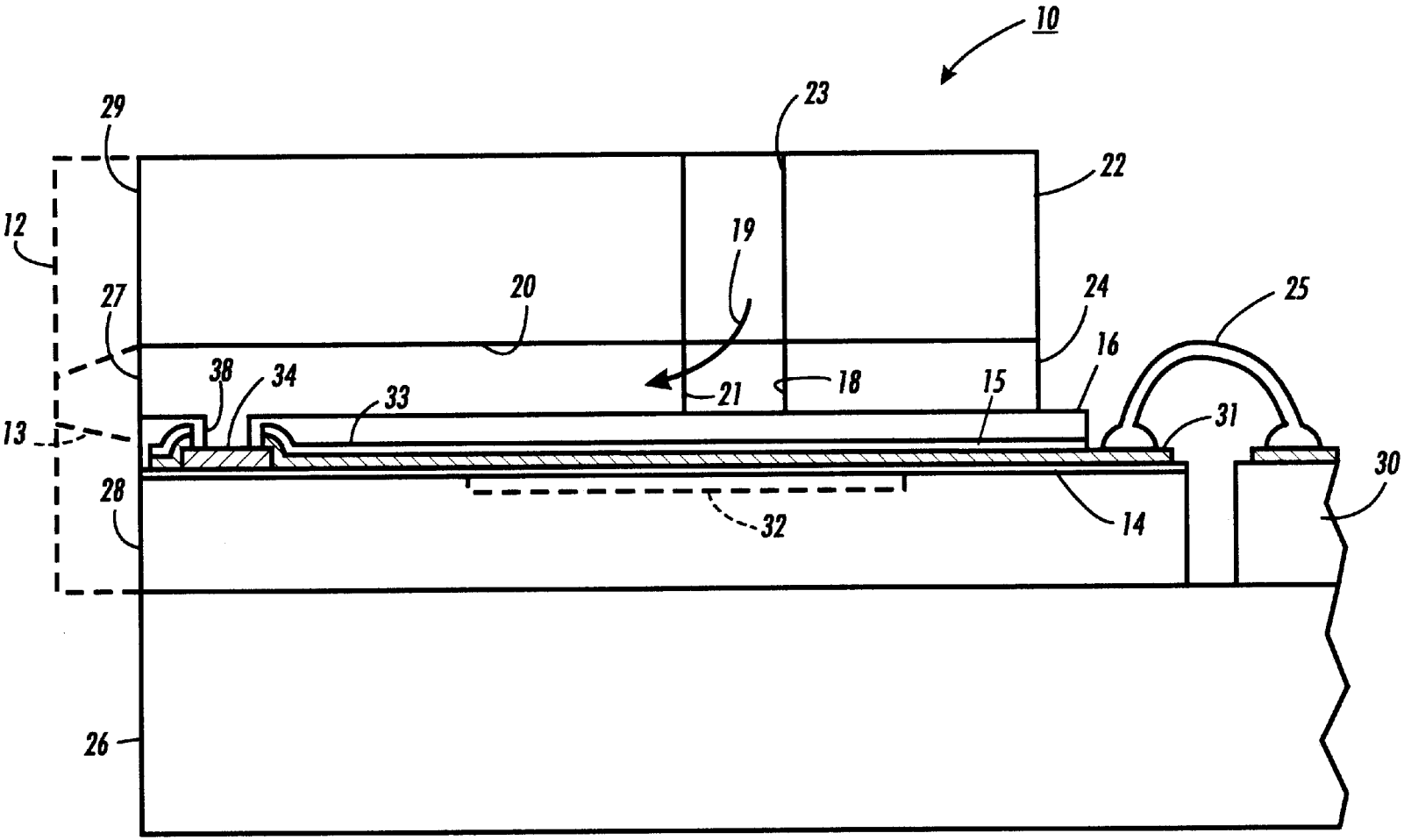
FIG. 2 is a cross-sectional view of the printhead of FIG. 1 as viewed along the view line 2—2 indicated therein.

In FIG. 1, a schematic isometric view of one embodiment of an ink jet printhead 10 in accordance with the present invention is shown mounted on a heat sink 26 and oriented to show the front face 29 of printhead and the array of droplet ejecting nozzles 27 therein. Referring also to FIG. 2, a cross-sectional view of the printhead as viewed along view line 2—2 of FIG. 1 is shown through an ink channel 20. The printhead has a silicon heater plate 28 with heating elements 34, addressing circuitry means 32 represented by dashed line, and leads 33 on one surface thereof. The leads interconnect the heating elements and addressing circuitry means and have contact pads 31 connected to a printed circuit board 30 by wire bonds 25. The circuit board is connected to a controller or microprocessor of the printer (neither shown). The controller selectively addresses the heating elements through the addressing means to eject ink droplets from the nozzles. One suitable addressing circuitry means is described in U.S. Pat. No. 4,947,192 and is hereby incorporated by reference.

Generally, an underglaze layer 14 of, for example, $SiO_2$ is formed on the heater plate surface on which the heating elements, addressing circuitry means, and leads are to be formed, followed by a passivation layer 15 which is patterned to expose the heating elements and contact pads. An optional thick film layer 16 of, for example, polyimide, may be deposited and patterned to provide pits 38 for the heating elements as disclosed in U.S. Pat. No. 4,774,530 and incorporated herein by reference. However, for high resolution printheads having nozzles spaced for printing at 600 spots per inch (spi) or more, heating element pits have been found not to be necessary, for the vapor bubbles generated to eject ink droplets from nozzles and channels of this size tend not to ingest air.

In this printhead embodiment, a photosensitive polymeric material is deposited over the thick film layer 16, if used, on the heater plate to form a channel structure 24, which is photolithographically patterned to produce the ink channels 20 and common manifold 18. Each channel has an open end to serve as a nozzle 27 and an end 21 which connects to a common manifold 18. The contact pads 31 of the electrical leads are also cleared of the channel structure 24 to enable the wire bonding. A cover plate 22 of glass, quartz, or ceramic material has an aperture 23 therethrough, and is bonded to the surface of the patterned photopolymeric channel structure 24 with a suitable adhesive epoxy adhesive (not shown). The cover plate aperture 23 has a cross-sectional area about the same size as the total cross-sectional areas of all of the channels 20 in the printhead in order to keep the ink flow rate through the reservoir relatively high and the time the ink is resident therein relatively short, so that air bubbles formed during the droplet ejection process are removed by subsequently ejected droplets. In the preferred embodiment, the ink channels have approximately 30×30 $\mu$m cross-sections, so that the cross-sectional area of the reservoir in the direction of ink flow is about that of one channel cross-sectional area times the number of channels. The exact value of the reservoir cross-sectional area is slightly larger than the total channel cross-sectional areas to account for flow impedance. The aperture 23 is shaped and positioned to align with the common manifold 18 into which the ends 21 of the channels connect and, as such, provides an adequate ink supply for the printhead. Thus, the aperture is generally elongated to enable ink flow communication with all of the channels opening into the common manifold. The ink flow path from the reservoir to the channels 20 is indicated by arrow 19. An optional nozzle plate 12 is shown in dashed line which is adhered to the printhead front face 29 with the nozzles 13 therein aligned with the open ends 27 of the channels 20 in the channel structure 24.

As disclosed in U.S. Pat. Nos. Re 32,572, 4,774,530, and 4,947,192 all of which are incorporated herein by reference, the heater plates of the present invention are batch produced on a silicon wafer (not shown) and later separated into individual heater plates 28 as one piece of the printhead 10. As disclosed in these patents, a plurality of sets of heating elements 34, addressing circuitry means 32 for each set of heating elements, and electrical leads 33 are patterned on a polished surface of a (100) silicon wafer which has first been coated with an underglaze layer 14, such as silicon dioxide having a thickness of about 2 $\mu$m. The heating elements may be any well known resistive material such as zirconium boride, but is preferably doped polycrystalline silicon deposited, for example, by chemical vapor deposition (CVD) and concurrently monolithically fabricated with the addressing circuitry means as disclosed in U.S. Pat. No. 4,947,193. Afterwards, the wafer is cleaned and re-oxidized to form a second silicon dioxide layer (not shown) over the wafer including the addressing circuitry means. A phosphorous doped glass layer or boron and phosphorous doped glass layer (not shown) is then deposited on the thermally grown second silicon dioxide layer (not shown) and is reflowed at high temperatures to planarize the surface. As is well known, photoresist is applied and patterned to form vias for electrical connections with the heating elements and the addressing circuitry means and aluminum metallization is applied to form the electrical leads and provide the contact pads. Any suitable electrically insulative passivation layer 15, such as, for example, polyimide, polyarylene, or bisbenzocyclobutene (BCB), is deposited over the electrical leads to a thickness of about 0.5 to 1.5 $\mu$m and removed from the heating elements and contact pads. Finally, the optional thick film layer 16 of polymeric material, such as, for example, polyimide is deposited to a depth sufficient to provide a thickness after curing of 10–50 $\mu$m. This thick film layer 16 is photopatterned to expose both the heating elements, thereby placing them in pits 38, and the contact pads 31.

If the topography of the completed heater plate wafer is uneven, the wafer is polished, for example, as disclosed in U.S. Pat. No. 5,665,249 and incorporated herein by reference, and then the photopatternable polymer which is to provide the channel structure 24 is deposited. As disclosed in U.S. Pat. No. 5,738,799 mentioned above, and incorporated herein by reference, a suitable channel structure material must be resistant to ink, exhibit temperature stability, be relatively rigid, and be readily diceable. The most versatile material for a channel structure is polyimide or polyarylene ether (PAE). In the preferred embodiment, OCG 7520 ™ polyimide is used, and because polyimide shrinks about 45 to 50% when cured, this must be taken into account when depositing a layer of polyimide on the heating element wafer. After deposition of the polyimide, it is exposed using a mask with the channel sets pattern and contact pads pattern. The patterned polyimide channel structure layer is developed and cured. In one embodiment, the channel structure thickness is 30 $\mu$m, so the original thickness deposited is about 65 $\mu$m, which shrinks to about 33 $\mu$m when cured and is then polished to the desired 30 $\mu$m. After the patterned channel structure layer 24 is cured and polished, a cover plate 22, the same size as the wafer and having a plurality of apertures 23 therein, is bonded thereto with each aperture aligned with the common manifold 18 into which the ends 21 of the sets of channels 20 open. The silicon wafer and wafer size cover plate with the channel structure sandwiched therebetween are separated into a plurality of individual printheads by a dicing operation. The dicing operation not only separates the printheads, but also produces the printhead front face 29 and opens one end of the channels to form the nozzles 27. An optional nozzle plate 12 is individually bonded to the printhead front faces, if desired. The printheads 10 are each bonded to a heat sink 26 together with a printed circuit board 30 and they are electrically connected by wire bonds 25. The circuit board is in turn connected to the printer controller (not shown) which controls the printer and effects the droplet ejection process through the addressing means 32.

Figure 3:
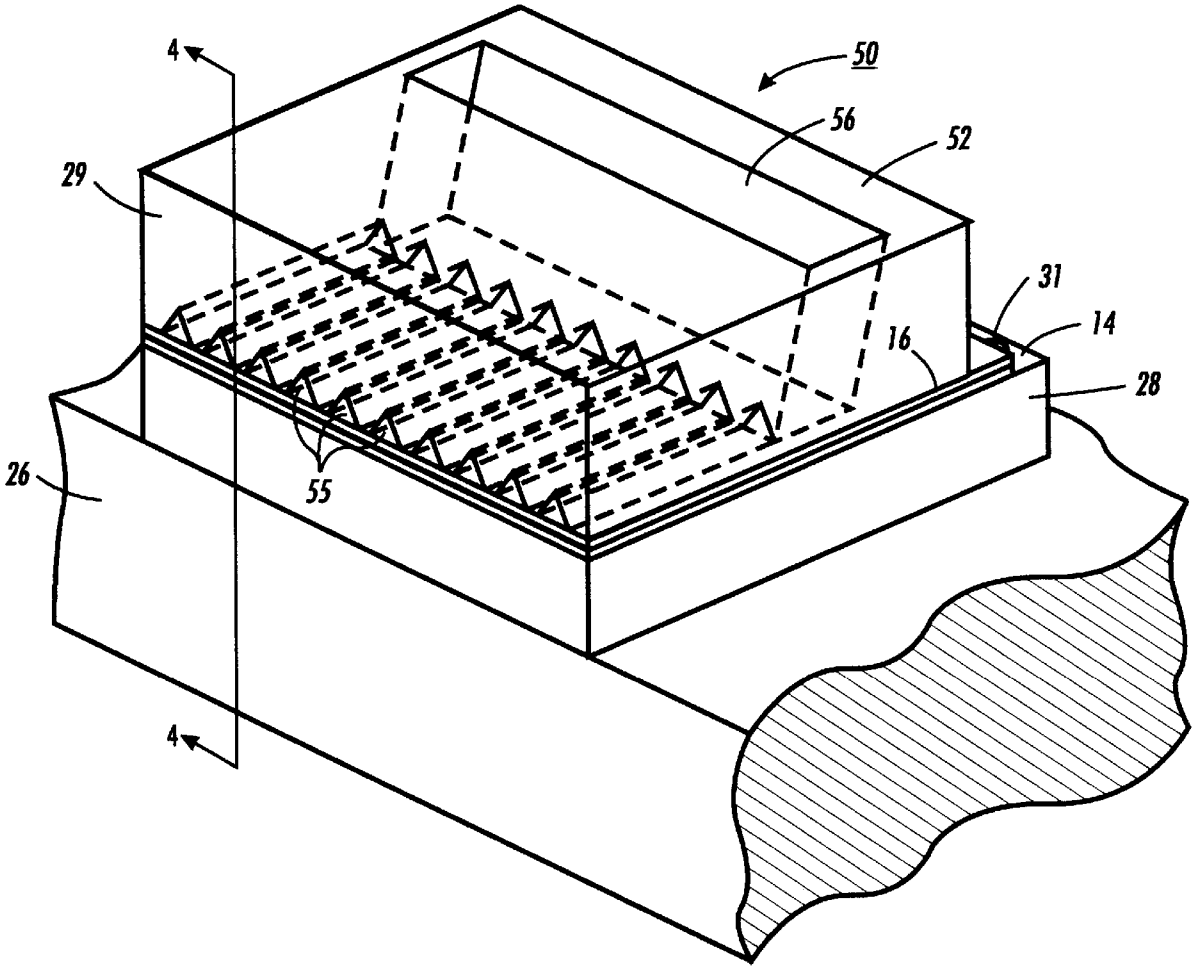
FIG. 3 is a schematic isometric view of an alternate embodiment of the printhead shown in FIG. 1.
Figure 4:
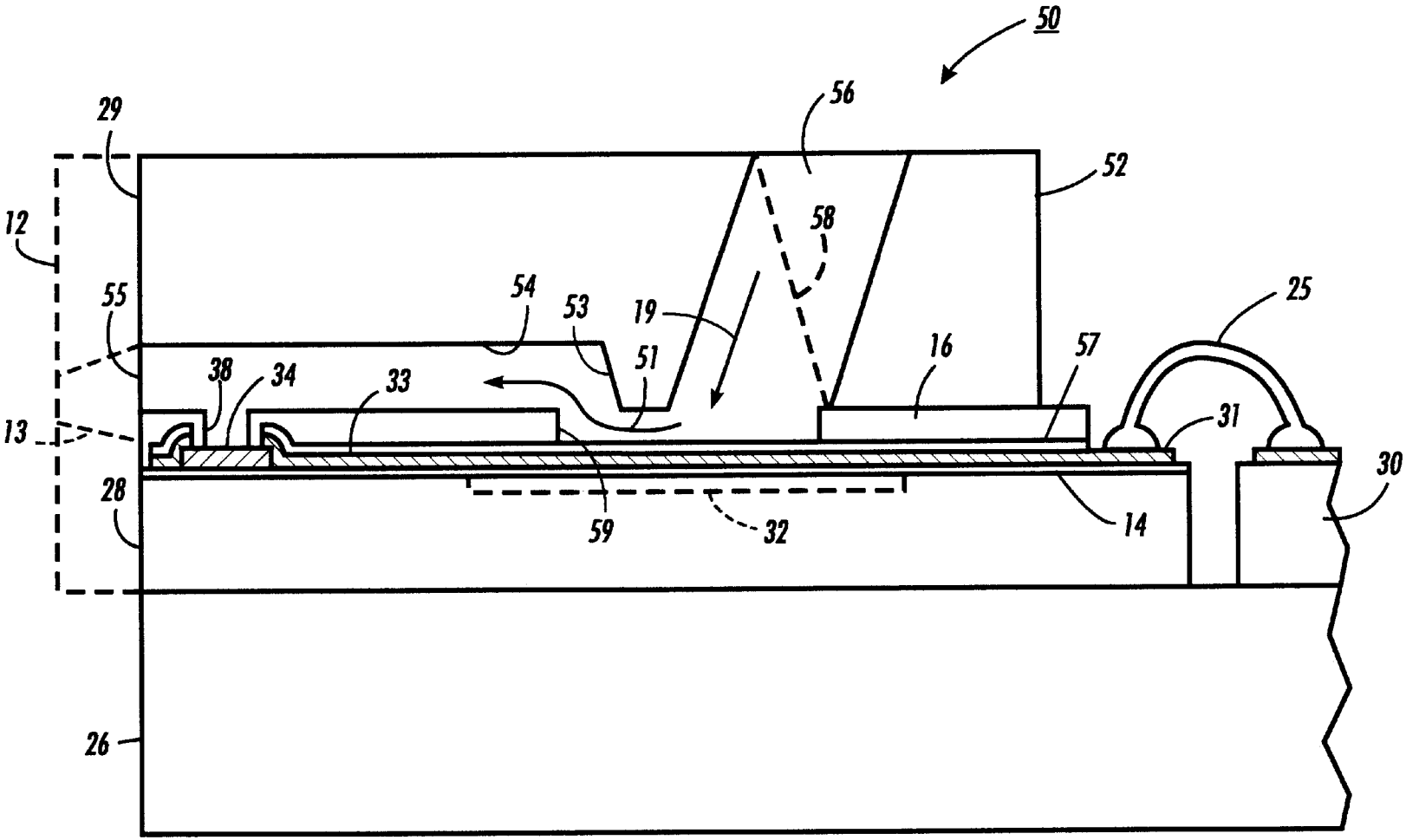
FIG. 4 is a cross-sectional view of the printhead of FIG. 3 as viewed along the view line 4—4 indicated therein.

FIG. 3 is a schematic isometric view of another ink jet printhead 50, an alternate embodiment of the printhead of FIG. 1, and FIG. 4 is a cross-sectional view of the alternate embodiment as viewed along view line 4—4 of FIG. 3. The difference between the printhead 10 in FIG. 1 and the printhead 50 is that the channel structure 24 and cover plate 22 of printhead 10 is replaced in printhead 50 with an etched silicon channel plate 52.

Another embodiment (not shown) of a printhead incorporating the present invention is a combination of the printheads disclosed in FIGS. 1 and 3. Namely, the silicon plate 52 of FIG. 3 having the ink inlet and reservoir 56, but without the etched channels 54, is bonded to the patterned channel structure 24 on the heater plate 28 of FIG. 1, which has the ink channels 20. Thus, the cover plate 22 of the printhead 10 in FIG. 1 is replaced with the silicon plate 52 of the printhead 50 in FIG. 3, except the silicon plate 52 does not have the etched channels 54. In this embodiment the modified silicon plate 52 serves as a cover plate similar to that in FIG. 1, but the aperture is slanted to provide a parallelogram shape in cross-section which is oriented to slant in a direction to prevent stagnant ink regions as depicted in FIG. 4.

The channel plate 52 is fabricated in a similar way as disclosed in U.S. Pat. No. 4,774,530 and incorporated herein by reference, except that the ink inlet and reservoir 56 are produced by substantially the same size via in the etch resistant masks (not shown) on opposite sides of the channel plate, which are offset from each other, so that the anisotropic etching of the inlet and reservoir 56 from both sides of the channel plate meet at the common {111} crystal plane shown in dashed line 58 and produce a more narrow reservoir which has a cross-sectional area having the shape of a parallelogram as shown in FIG. 4. This particular shape of the reservoir 56 has the benefit that there are no stagnant flow areas which impede the movement of any exsolved gas or air bubbles from the printhead reservoir. The channels 54 have a triangular cross-sectional area and penetrate the front face 29 to form triangular shaped nozzles 55. The reservoir 56 has a cross-sectional area established in the same way as for the printhead 10 in FIG. 1; viz., about equal to the total cross-sectional areas of the array of channels, plus an increase in size necessary to overcome the ink flow impedance, so that ink refill is not slowed. The channel ends 53 opposite the nozzles are closed, so that the thick film layer 16 must be patterned to form a bypass trench 59 concurrently with the patterning of the pits 38, in order to provide a flow path between the channels and the reservoir as depicted by arrow 51.

In accordance with U.S. Pat. No. 4,774,530 the channel plate 52 is formed from a two side polished, (100) silicon wafer (not shown) to produce a plurality of channel plates 52 for the printhead 50. After the wafer is chemically cleaned, a pyrolytic CVD silicon nitride layer (not shown) is deposited on both sides. Using conventional photolithography, a via (not shown) for the ink inlet side of the reservoir 56 of each of the plurality of channel plates 52 are patterned to expose the silicon wafer. An anisotropic etch, such as potassium hydroxide (KOH), etches the silicon along the {111} planes, so that the size of the via determines the depth of the apex of the pyramidal recesses. In the preferred embodiment, the size is such as to enable the etched recesses to substantially etch through the wafer. Next, the opposite side of the wafer is photolithographically patterned to form the plurality of sets of parallel channels 54 and a recess adjacent each set of channels (and inlet recess) which is about the same size as the recesses on the other side of the wafer. The location of the recesses on the channel set side of the wafer is offset from the recesses etched from the other side so that the etch recesses have a common {111} plane 58 with the first etched recesses shown in dashed line. Therefore, the common plane disappears and the two combined slightly offset etched recesses form the parallelogram shaped inlet and reservoir 56. The surface of the wafer having the channel sets is aligned and bonded to the heater wafer, so that each channel has a heating element therein. The bonded wafers are separated into a plurality of individual printheads 50 by a dicing operation. One of the dicing cuts forms the front face 29 of the printhead and opens one end of the channels to provide the nozzles 55. As with printhead 10 in FIG. 1, an optional nozzle plate 12 shown in dashed line with nozzles 13 therein may be aligned and bonded to the printhead front face, so that the nozzles in the nozzle plate are aligned with the channel nozzles 55.

Figure 5:
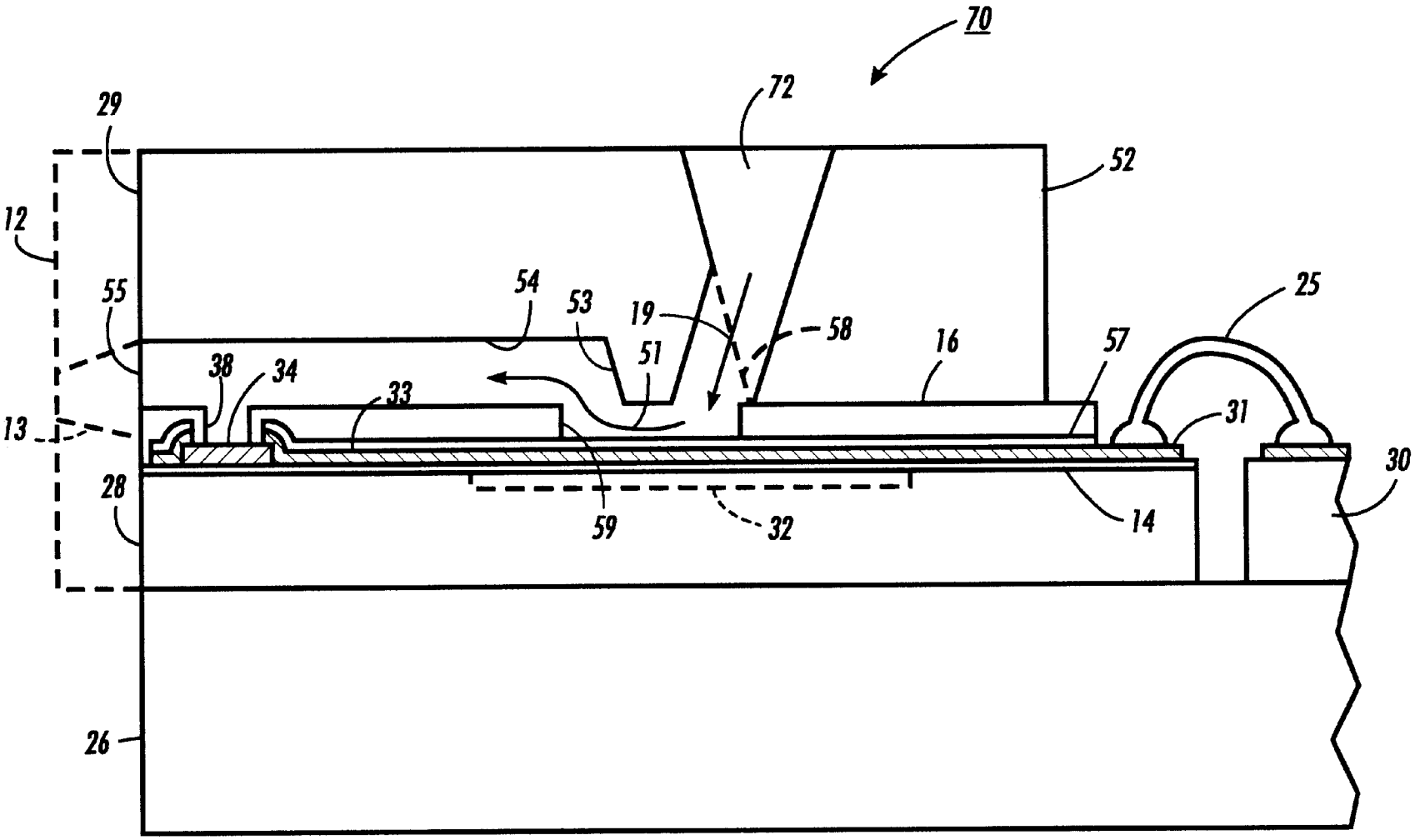
FIG. 5 is a cross-sectional view of another embodiment of the printhead of FIG. 4.

Another printhead embodiment 70 is shown in FIG. 5, which is similar to the printhead 50 in FIG. 4. The only difference is that the volume of the reservoir is reduced by reducing the size of the recesses etched adjacent the sets of channels 54, so that the depth of the apex of the pyramidal recesses are less than the thickness of the wafer, but still meet the previously etched recesses at a common crystal plane 58. The cross-sectional shape of the reservoir 72 is similar to a 'Y', and retains all of the advantages of the parallelogram shaped reservoir in printhead 50; namely, low volume to keep the resident time of the ink in the reservoir short and narrow cross-sectional area to cause a high refill flow rate.

The printheads of each embodiment keep the air bubbles swept from the reservoir, so that they do not coalesce into larger bubbles which deleteriously affect print quality. Another advantage of this high flow rate of ink supply from the reservoir is that the high flow rate and low residency of the ink ensures that the ink does not reside long in the printhead, minimizing the time the ink can pick up dissipated waste heat, especially during high area coverage printing. Since the air solubility in ink is inversely proportional to temperature, the higher the temperature the more the ink is capable of exsolving air bubbles in the printhead reservoirs. Therefore, the printhead reservoir configurations of the present invention eliminates stagnant ink areas and causes high ink flow rates during refills with the benefit of short ink residency thereby providing the desired bubble management.

Although the foregoing description illustrates the preferred embodiment, other variations are possible and all such variations as will be apparent to those skilled in the art are intended to be included within the scope of this invention as defined by the following claims.

We claim:

1. An ink jet printhead which prevents accumulation of air bubbles therein, comprising:

a heater plate having on one surface thereof an array of heating elements, addressing circuitry means, and electrical leads for the selective application of electrical pulses to each of the heating elements, each of the selectively applied pulses ejecting an ink droplet from the printhead; and a planar structure having a plurality of ink flow directing channels with substantially equal cross-sectional areas and opposing ends, the channels having one end open and the other end in fluid communication with an ink reservoir, the reservoir having an ink inlet and providing an ink supply from which the channels are capillarily refilled when ink droplets are ejected from the printhead, the reservoir having a cross-sectional area in an orientation substantially perpendicular to the ink flow direction therethrough, which, is substantially equal to the total cross-sectional areas of the plurality of the channels in the ink flow direction, thereby providing an ink volume in the reservoir which is sufficiently low to prevent the ink therein from residing for a relatively long time period during a printing operation and maintaining a relatively high ink flow rate through the reservoir during a printing operation, so that air bubbles, formed during the droplet ejection process are removed with subsequent droplet ejections.

2. The printhead as claimed is claim 1, wherein the reservoir is shaped to eliminate a stagnant ink region therein; and wherein the sufficiently low reservoir volume minimizes the time the ink in the reservoir can absorb waste heat from said heating elements and exsolve air bubbles.

3. The printhead as claimed in claim 1, wherein the planar structure is a photosensitive polymeric layer patterned to produce the ink channels; wherein a cover plate having an aperture therein is aligned and bonded to the patterned polymeric layer, so that the cover plate aperture serves as the ink inlet; and wherein the cross-sectional flow area of the cover plate aperture is substantially equal to the total cross-sectional areas of the plurality of ink channels.

4. The printhead as claimed in claim 3, wherein the ink channel ends opposite the open ends is connected to a common manifold; wherein the cover plate aperture is aligned with the common manifold; and wherein the ink reservoir is a combination of the cover plate aperture and the common manifold in the polymeric layer.

5. The printhead as claimed in claim 3, wherein the cover plate is a (100) silicon substrate; wherein the aperture in the cover plate is produced by separately anisotropic etching the cover plate from both sides, so that the separate etchings have a common {111} crystal plane.

6. The printhead as claimed in claim 5, wherein the cover plate aperture has a cross-sectional shape of a parallelogram.

7. The printhead as claimed din claim 5, wherein the cover plate aperture has a cross-sectional shape of a "Y".

8. The printhead as claimed in claim 1, wherein the planar structure is a silicon substrate; and wherein the channels and aperture are produced by anisotropic etching, the aperture being produced by separately etching opposing sides of the silicon substrate in a manner such that the separate etchings have a common {111} crystal plane.

9. A method of fabricating an ink jet printhead which prevents accumulation of air bubbles therein, comprising the steps of:

(a) providing a heater plate having on one surface thereof an array of heating elements, addressing circuitry means, and electrical leads for the selective application of electrical pulses to each of the heating elements, each of the selectively applied pulses ejecting an ink droplet from the printhead;

(b) depositing a photosensitive polymeric layer on the heater plate surface having the array of heating elements;

(c) patterning the polymeric layer to produce a common manifold and a plurality of ink flow directing channels with substantially equal cross-sectional areas and opposing ends, the channels having one end open and the other end connected to said common manifold; and (d) aligning and bonding a cover plate having an aperture therein to the patterned polymeric layer, so that the cover plate aperture is aligned with the common manifold in the polymeric layer and the cover plate aperture and common manifold form an ink reservoir for the printhead, the cover plate aperture having a cross-sectional flow area substantially equal to the total cross-sectional flow area of the plurality of channels, so that a relatively high flow rate through the reservoir is maintained, thereby removing any air bubbles formed during the droplet ejection process with subsequently ejected ink droplets.

10. The method as claimed in claim 9, wherein the cover plate is a (100) silicon substrate; and wherein the aperture in the silicon substrate is produced by anisotropically etching from opposing sides of the silicon substrate in such a manner that the etching from the opposing sides have a common {111} crystal plane which disappears at the conclusion of the etching.

* * * * *